US005263688A

United States Patent [19]

Krueger

[11] Patent Number: 5,263,688

[45] Date of Patent: Nov. 23, 1993

[54] LIFT HOIST APPARATUS WITH ENDLESS DRIVE CHAIN AND DIFFERENTIAL DRIVE SPROCKETS

[76] Inventor: Leonard D. Krueger, 4101 Cork Dr., Laporte, Calif. 80535-9356

[21] Appl. No.: 953,074

[22] Filed: Sep. 29, 1992

[51] Int. Cl.[5] ..... B66D 1/14; B66D 1/30

[52] U.S. Cl. ..... 254/337; 254/372; 254/358; 74/89.21

[58] Field of Search ..... 254/372, 358, 337, 336, 254/335; 74/89.21; 474/84–86

[56] References Cited

U.S. PATENT DOCUMENTS

| | | | |
|---|---|---|---|
| 48,044 | 6/1965 | Bird | 254/358 X |
| 348,200 | 8/1886 | Flinn | 354/372 X |
| 756,454 | 4/1904 | Astrup | 254/358 X |
| 1,112,153 | 9/1914 | Moore et al. | 254/372 X |
| 2,133,910 | 10/1938 | Vollmer | 254/372 X |
| 3,750,199 | 8/1973 | Spivey | 5/83.1 |
| 4,117,561 | 10/1978 | Zamotin | 5/83.1 |
| 4,151,981 | 5/1979 | Gennep | 254/336 |
| 4,236,694 | 12/1980 | Kristensson | 254/365 |
| 4,387,473 | 6/1983 | Gettner | 5/81.1 |
| 4,627,119 | 12/1986 | Hachey et al. | 5/83.1 |
| 4,805,248 | 2/1989 | Lunan | 5/83.1 |

*Primary Examiner*—Daniel P. Stodola
*Assistant Examiner*—Michael P. Mansen
*Attorney, Agent, or Firm*—John R. Flanagan

[57] ABSTRACT

A differential lift hoist apparatus includes an endless roller-and-link chain and upper and lower rotatably mounted spaced sprockets. The chain includes a pair of vertically-extending side-by-side loop sections. Each loop section has outer and inner leg portions and a lower bight portion interconnecting them. The chain also includes an upper bight section which interconnects the outer leg portions and a lower bight section which interconnects the inner leg portions. A group of the upper sprockets entrain and support the upper bight section, whereas a single upper sprocket spaced below the group of upper sprockets entrains and supports the lower bight section. The lower sprockets entrain and are supported by the respective lower bight portions of the chain loop sections. The apparatus also includes a differential arrangement connecting the single upper sprocket with one of the group of upper sprockets to cause movement of the upper bight section at a speed faster than the lower bight section such that one loop section decreases in length as the other increases in length or vice versa depending upon the direction of chain movement. The chain can be driven at a shaft end extending from at least one of the upper and lower sprockets by using a tool to applying a rotary motion thereto to move the chain and rotate the spockets.

25 Claims, 2 Drawing Sheets

FIG. 3
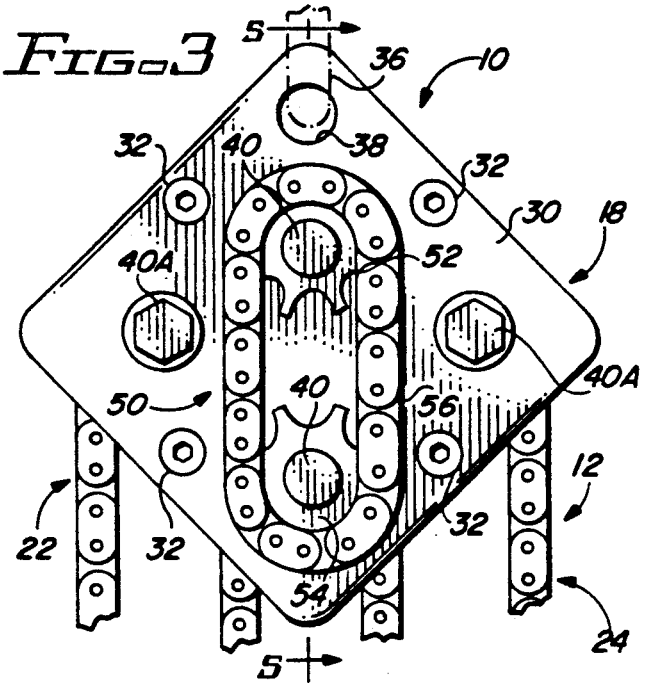
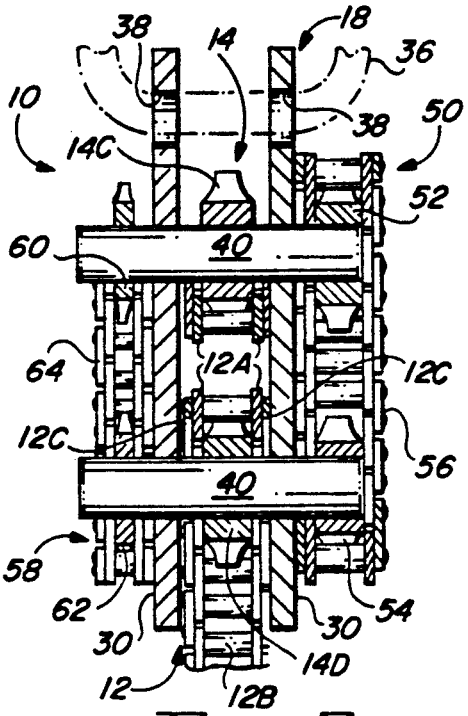
FIG. 5
FIG. 4
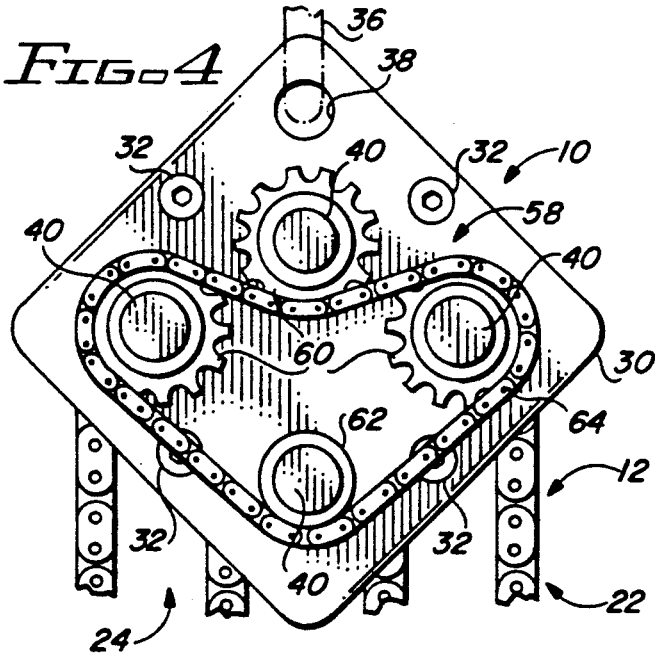

LIFT HOIST APPARATUS WITH ENDLESS DRIVE CHAIN AND DIFFERENTIAL DRIVE SPROCKETS

BACKGROUND OF THE INVENTION

1. Field of the Invention

The present invention generally relates to an apparatus for lifting loads and, more particularly, is concerned with a lift hoist apparatus with endless drive chain and differential drive sprockets.

2. Description of the Prior Art

Disabled and incapacitated persons must often resort to manual assistance in transferring from a bed to a wheelchair and vice versa. Also washing, dressing, and toilet activities by such persons can often require assistance in movement. Many different designs of lifting apparatuses are known in the art for these purposes. Some representative examples of such apparatuses are found in U.S. patents to Spivey (U.S. Pat. No. 3,750,199), Zamotin (U.S. Pat. No. 4,117,561), Kristensson (U.S. Pat. No. 4,236,694), Gettner (U.S. Pat. No. 4,387,473), Hachey et al (U.S. Pat. No. 4,627,119) and Lunau (U.S. Pat. No. 4,805,248).

Suitable lift apparatuses for use in institutions, homes, and hospital settings to assist disabled and incapacitated persons, should be able to perform lifting operations gradually, smoothly and safely so that such persons are not discomforted nor endangered in any way. Preferably, the lift apparatuses should be capable of operation by ordinary persons without special skills nor above average strength. Most current lift apparatuses fall short of reaching these objectives.

Thus, a need still exists for improvement of the design of lift apparatuses for use in different settings to assist movement of disabled and incapacitated persons.

SUMMARY OF THE INVENTION

The present invention provides a differential lift hoist apparatus designed to satisfy the aforementioned need. The differential lift hoist apparatus of the present invention employs an endless drive chain and differential drive sprockets which operable in a manner that allows ordinary individuals of more or less average physical strength to safely and easily lift persons of considerable size without the need to expend unusual physical effort.

Accordingly, the present invention is directed to a differential lift hoist apparatus which comprises: (a) an endless flexible roller-and-link type chain including a pair of loop sections extending vertically and disposed in side-by-side relation to one another with each loop section having outer and inner leg portions and a lower bight portion interconnecting the inner and outer leg portions, the chain also including an upper bight section interconnecting the outer leg portions and a lower bight section interconnecting the inner leg portions; (b) a plurality of upper sprockets rotatably mounted in spaced relation to one another and including a group of upper sprockets entraining and supporting the chain at the upper bight section thereof and at least a single upper sprocket spaced below the group of upper sprockets entraining and supporting the chain at the lower bight section thereof; (c) a pair of rotatably mounted lower sprockets each entraining and supported by one of the lower bight portions of a respective one of the loop sections of the chain; (d) means for drivingly connecting the single upper sprocket and at least one of the group of upper sprockets so as to cause movement of the upper bight section of the chain at a speed faster than the lower bight section of chain such that one of the loop sections of the chain decreases in length as the other of the loop sections of the chain increases in length or vice versa depending upon the direction of movement of the chain relative to the plurality of upper sprockets; and (e) means connected to at least one of the upper and lower sprockets for applying a rotary motion thereto to move the chain and rotate the spockets.

More particularly, the means for drivingly interconnecting the respective upper sprockets includes a differential arrangement coupled with the one of the group of upper sprockets and the single upper sprocket. The differential arrangement includes a pair of differential sprockets mounted for rotation with the one of the group of upper sprockets and the single upper sprocket and a roller-and-link type chain entrained over the pair of differential sprockets. The one of the differential sprockets mounted with the single upper sprocket is larger in diameter than the one of the group of upper sprockets. Further, the means for applying rotary motion includes a shaft rotatably mounting the one sprocket and having an end extending therefrom for coupling with a tool to apply the rotary motion thereto to move the chain and rotate the spockets.

The hoist apparatus also includes a pair of upper plates mounted in a side-by-side fixed spaced relation to one another and shafts mounting the upper sockets between the plates, and pair of lower couplers having internal cavities open at one end and mounting the lower sprockets. Either one of the couplers is connectable to a load to be lifted. Futher, the hoist apparatus includes a timing arrangement coupled to the upper sprockets so as to cause the upper sprockets to rotate in unison.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 3 is an enlarged fragmentary view of an upper rear portion of the differential sprocket and chain drive train of the hoist apparatus of FIG. 1.

FIG. 4 is an enlarged fragmentary view of an upper front portion of the differential sprocket and chain drive train of the hoist apparatus of FIG. 1.

FIG. 5 is an enlarged cross-sectional view of the upper portion of the drive train taken along line 5—5 of FIG. 3.

DETAILED DESCRIPTION OF THE INVENTION

Figure 1:
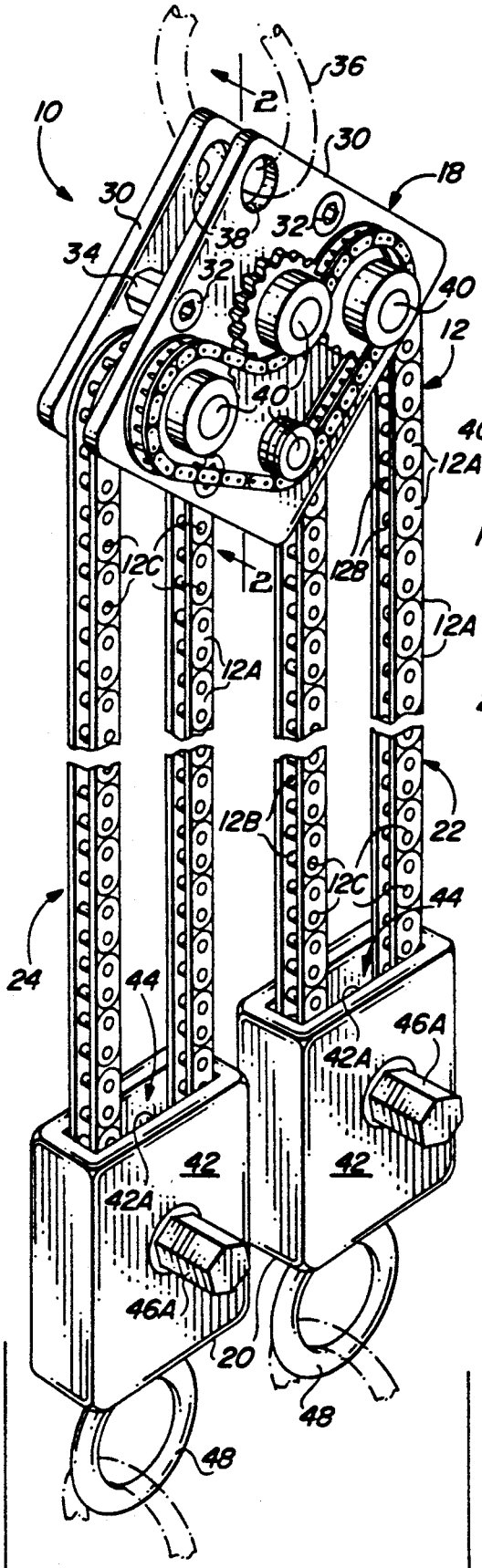
FIG. 1 is a front perspective view of a differential lift hoist apparatus of the present invention.
Figure 2:
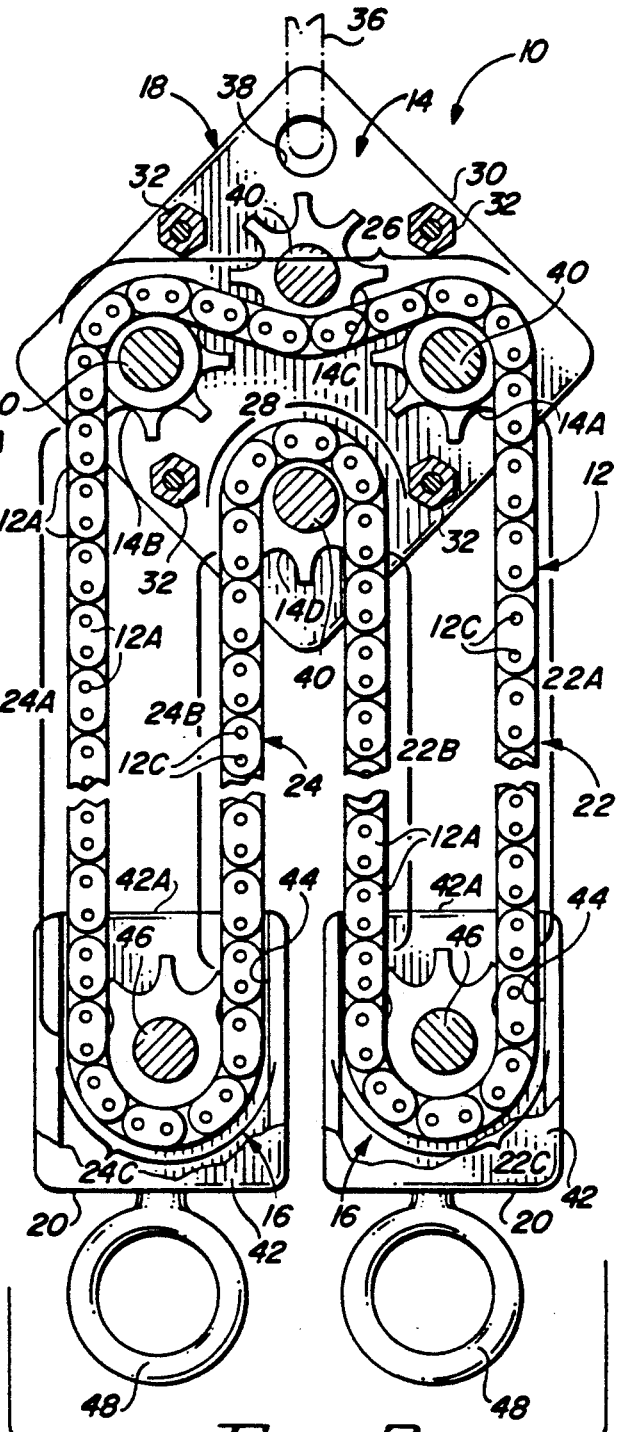
FIG. 2 is a vertical sectional view of the hoist apparatus taken along line 2—2 of FIG. 1.

Referring to the drawings, and particularly to FIGS. 1 to 3, there is illustrated a differential lift hoist apparatus, generally designated 10, constructed in accordance with the principles of the present invention. The hoist apparatus 10 basically includes an endless flexible roller-and-link type chain 12, a plurality of upper and lower rotatably mounted spaced sprockets 14, 16, an upper support frame assembly 18, and a pair of lower couplers 20.

Referring to FIGS. 1 to 5, the roller-and link type chain 12 is constructed of an endless succession of pairs of link plates 12A alternately offset from one another, a succession of chain rollers 12B disposed transversely between the pairs of link plates 12A, and a succession of roller pins 12C rotatably supporting the chain rollers 12B and supported transversely between and connected to the pairs of link plates 12A. The rollers 12B are spaced apart at the same pitch as the teeth of the respective upper and lower sprockets 14, 16. The upper and lower sprockets 14, 16 are substantially identical to one another and therefore have the same diameter and the same number of peripheral teeth spaced apart at the same pitch.

Referring to FIGS. 1 to 4, the chain 12 includes a pair of right and left loop sections 22, 24 (as viewed in FIGS. 1 and 2) extending vertically in side-by-side relation to one another, and upper and lower bight sections 26, 28 interconnecting the right and left loop sections 22, 24. Each loop section 22, 24 has outer and inner leg portions 22A, 22B and 24A, 24B and a lower bight portion 22C, 24C connecting with the inner and outer leg portions. The upper bight section 26 of the chain 12 interconnects the outer leg portions 22A, 24A, whereas the lower bight section 28 of the chain 12 interconnects the inner leg portions 22B, 24B. In the above-described arrangement, the chain 12 has an overall inverted substantially U-shaped configuration and the pair of loop sections 22, 24 of the chain 12 have respective upright substantially U-shaped configurations.

Referring to FIGS. 2 and 5, the upper sprockets 14 of the hoist apparatus 10 entrain and support the chain 12 at the respective upper and lower bight sections 26, 28 thereof. In particular, a group of the upper sprockets 14A, 14B, 14C entrain and support the chain 12 at the upper bight section 26, whereas a single upper sprocket 14D spaced below the group of upper sprockets 14A, 14B, 14C entrains and supports the chain 12 at the lower bight section 28. The group of upper sprockets 14 includes the three upper sprockets 14A, 14B, 14C being arranged in a triangular relationship wherein first and second upper sprockets 14A, 14B are spaced horizontally from one another and a third sprocket 14C is disposed between and spaced vertically from the first and second sprockets 14A, 14B. In the preferred arrangement, the group of upper sprockets 14A, 14B, 14C entrain and support the chain 12 by the upper bight section 26 thereof passing over the first and second sprockets 14A, 14B and under the third sprocket 14C. The single upper sprocket 14D entrains and supports the chain 12 by the lower bight section 28 thereof passing over the single upper sprocket 14D.

Referring again to FIGS. 1 to 4, the upper support frame assembly 18 of the hoist apparatus 10 includes a pair of upper plates 30 mounted in a side-by-side fixed spaced relation to one another by a plurality of fasteners 32 and spacers 34. A ring 36, being shown in phantom in FIGS. 1 to 5, can be inserted through a pair of aligned holes 38 formed in the upper plates 30 and used to hang the support frame assembly 18 from a suitable support structure (not shown). The upper sprockets 14 are mounted by shafts 40 rotatably supported between the plates 30.

Referring to FIGS. 1 and 2, the lower sprockets 16 of the hoist apparatus 10 entrain and are supported by the chain 12 at the respective lower bight portions 22C, 24C thereof. The lower couplers 20 having rectangular block-like bodies 42 with internal cavities 44 being open at upper ends 42A. The lower sprockets 16 are mounted in the internal cavities 44 by respective shafts 46 rotatably supported by the couplers 20. Also, there are rings 48 attached to the lower couplers 20 which can be used to connect to a load to support the load from either one of the lower couplers 20 for lifting the load using of the hoist apparatus 10.

Referring to FIGS. 3 and 5, the hoist apparatus 10 also includes means 50 for drivingly interconnecting the single upper sprocket 14D and at least one of the group of upper sprockets, preferably the third or middle upper sprocket 14C, so as to cause movement of the upper bight section 26 of the chain 12 at a speed faster than the lower bight section 28 of chain 12 such that one of the loop sections 22, 24 of the chain 12 decreases in length as the other of the loop sections 22, 24 of the chain 12 increases in length, or vice versa, depending upon the direction of movement of the chain 12 relative to upper sprockets 14. The means 50 for drivingly interconnecting the respective pair of upper sprockets 14C, 14D preferably is a differential arrangement 50 coupled therewith. The differential arrangement 50 includes a pair of upper and lower differential sprockets 52, 54 and a roller-and-link type chain 56 entrained respectively over and under the pair of differential sprockets 52, 54. The differential sprockets 52, 54 are mounted on end portions of the respective pair of the shafts 40 which protrude beyond the side of the frame assembly 18 and mount the third upper sprocket 14C and the single upper sprocket 14C. Thus, the upper and lower differential sprockets 52, 54 rotate in unison with the upper sprockets 14. However, the lower differential sprocket 54 coupled for rotation with the single upper sprocket 14D is larger in diameter and has one more peripheral tooth than the upper sprockets 14. For instance, the upper and lower sprockets 14, 16 and upper differential sprocket 52 all have eight peripheral teeth, whereas the lower differential sprocket has nine peripheral teeth. Thus, the rotational speed of the lower differential sprocket 54 is slower than that of the upper differential sprocket 52 and the upper sprockets 14A, 14B, 14C, whereas the rotational speed of the single upper sprocket 14D is the same as that of the lower differential sprocket 54. As a result, as the single upper sprocket 14D is rotated in a clockwise direction as viewed in FIG. 2, the right loop section 24 decreases in length concurrently as the left loop section 26 increases in length. Thus, a load carried by the right loop section 24 of the chain 12 would be lifted by such direction of movement of the chain 12. As the single upper sprocket 14D is rotated in a counterclockwise direction as viewed in FIG. 2, then the right loop section 24 increases in length concurrently as the left loop section 26 decreases in length. In this case, the load carried by the right loop section 24 of the chain 12 would be lowered by such direction of movement of the chain 12.

Referring to FIGS. 1 and 3, the hoist apparatus 10 further includes means connected to at least one and preferably to several of the upper and lower sprockets 14, 16 for applying a rotary motion thereto effective to rotate the sprockets 14, 16 and to move the chain 12 in the directions described above. The rotary motion applying means are end portions 40A, 46A of certain of the shafts 40, 46 respectively mounting the upper and lower sprockets 14, 16 which protrude respectively from the upper support frame assembly 18 and the lower couplers 20 and are shaped, such as a hexagon, for coupling with a complementary socket of a tool (not shown) to apply the necessary rotary motion thereto to move the chain 12 and rotate the sprockets 14, 16. The tool used can either be manually actuated or power actuated. An example of a suitable tool is a ratchet socket wrench.

Referring to FIGS. 1 and 4, the hoist apparatus 10 still further includes a timing arrangement 58 coupled to the upper sprockets 14 so as to cause the group of upper sprockets 14A, 14B, 14C, but not the single upper sprocket 14D, to rotate in unison. The timing arrangement 58 includes a plurality of auxiliary sprockets 60 mounted along an outer side of the frame assembly 18 to outer end portions of the shafts 40 supporting the upper sprockets 14A, 14B, 14C, a toothless sprocket 62 mounted to the outer end portion of the shaft 40 supporting the single upper sprocket 14D, and an auxiliary roller chain 64 entrained over the auxiliary sprockets 60 and toothless sprocket 62.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A differential lift hoist apparatus, comprising:

(a) an endless flexible roller-and-link type chain includinq a pair of loop sections extending vertically and disposed in side-by-side relation to one another with each said loop section having outer and inner leg portions and a lower bight portion interconnecting said inner and outer leg portions, said chain also including an upper bight section interconnecting said outer leg portions of said respective loops sections and a lower bight section interconnecting said inner leg portions of said respective loop sections;

(b) a plurality of upper sprockets rotatably mounted in spaced relation to one another and including a group of first upper sprockets entraining and supporting said chain at said upper bight section thereof and at least a single second upper sprocket spaced below said group of upper sprockets entraining and supporting said chain at said lower bight section thereof;

(c) a pair of rotatably mounted lower sprockets each entraining and supported by one of said lower bight portions of a respective one of said loop sections of said chain;

d) means for drivingly interconnecting said single second upper sprocket and at least one of said group of first upper sprockets so that movement of said upper bight section of said chain is at a speed faster than said lower bight section of chain such that one of said loop sections of said chain decreases in length as the other of said loop sections of said chain increases in length depending upon the direction of movement of said chain; and (e) means connected to at least one of said upper and said lower sprockets for applying a rotary motion thereto to move said chain and rotate said spockets.

2. The apparatus of claim 1 wherein said group of first upper sprockets includes three sprockets arranged in a triangular relationship wherein first and second sprockets are spaced horizontally from one another and a third sprocket is disposed between and spaced vertically from said pair of sprockets.

3. The apparatus of claim 2 wherein said group of first upper sprockets entrains and supports said upper bight section of said chain by said upper bight section thereof passing over said first and second sprockets and under said third sprocket.

4. The apparatus of claim 2 wherein said means for drivingly interconnecting said respective upper sprockets includes a differential arrangement coupled with said third first upper sprocket and said single second upper sprocket.

5. The apparatus of claim 4 wherein said differential arrangement includes a pair of differential sprockets respectively mounted for rotation with said third first upper sprocket and said single second upper sprocket and a roller-and-link type chain entrained over said pair of differential sprockets, one of said differential sprockets being larger in diameter the other thereof.

6. The apparatus of claim 5 wherein said one of said differential sprockets having the larger diameter is mounted for rotation with said single second upper sprocket.

7. The apparatus of claim 1 wherein said single second upper sprocket entrains and supports said lower bight section of said chain by lower bight section thereof passing over said single second upper sprocket.

8. The apparatus of claim 1 wherein said upper sprockets have the same diameter and include the same number of peripheral teeth.

9. The apparatus of claim 1 wherein said means for applying rotary motion includes a shaft rotatably mounting said at least one of said upper and said lower sprockets and having an end extending therefrom for coupling with a tool to apply the rotary motion thereto to move the chain and rotate the spockets.

10. The apparatus of claim 1 further comprising:

a timing arrangement coupled to said group of first upper sprockets so as to cause said group or first upper sprockets to rotate in unison.

11. The apparatus of claim 1 wherein said means for drivingly interconnecting said respective upper sprockets includes a differential arrangement coupled with said one of said group of first upper sprockets and said single second upper sprocket.

12. The apparatus of claim 11 wherein said differential arrangement includes a pair of differential sprockets mounted for rotation with said one of said group of first upper; sprockets and said single single upper sprocket and a roller-and-link type chain entrained over said pair of differential sprockets, the one of said differential sprockets mounted with said single upper sprocket being larger in diameter than the other of said differential sprockets.

13. The apparatus of claim 1 wherein said means for applying rotary motion includes a plurality of shafts respectively mounting each of said upper sprockets, at least one of said shafts having an end extending therefrom for coupling with a tool to apply the rotary motion thereto to move the chain and rotate the spockets.

14. The apparatus of claim 13 further comprising:

a support frame assembly including a pair of plates mounted in a side-by-side fixed spaced relation to one another and mounting said shafts such that said upper sprockets are disposed between said plates.

15. The apparatus of claim 13 further comprising:

a timing arrangement mounted to said plurality of shafts so as to cause said group of first upper sprockets to rotate in unison.

16. The apparatus of claim 1 wherein said means for applying rotary motion includes a pair of shafts respectively mounting said lower sprockets, at least one of said shafts having an end extending therefrom for coupling with a tool to apply the rotary motion thereto to move the chain and rotate the sprockets.

17. A differential lift hoist apparatus, comprising:

(a) a support frame assembly including a pair of plates mounted in a side-by-side fixed spaced relation to one another;

(b) an endless flexible roller-and-link type chain including a pair of loop sections extending vertically and disposed in side-by-side relation to one another with each said loop section having outer and inner leg portions and a lower bight portion interconnecting said inner and outer leg portions, said chain also including an upper bight section interconnecting said outer leg portions of said respective loops sections and a lower bight section interconnecting said inner leg portions of said respective loop sections;

(c) a plurality of upper sprockets rotatably mounted between said plates and in spaced relation to one another and including a group of first upper sprockets entraining and supporting said chain at said upper bight section thereof and at least a single second upper sprocket spaced below said group of first upper sprockets entraining and supporting said chain at said lower bight section thereof;

(d) a pair of couplers at least one of which is connectable to a load to be lifted;

(e) a pair of lower sprockets each rotatably mounted to one of said couplers and entraining and supported by one of said lower bight portions of a respective one of said loop sections of said chain;

(f) means for drivingly interconnecting said single second upper sprocket and at least one of first said group of upper sprockets so that movement of said upper bight section of said chain is at a speed faster than said lower bight section of chain such that one of said loop sections of said chain decreases in length as the other of said loop sections of said chain increases in length depending upon the direction of movement of said chain; and (g) means connected to at least one of said upper and said lower sprockets for applying a rotary motion thereto to move said chain and rotate said spockets.

18. The apparatus of claim 17 wherein said group of first upper sprockets includes three sprockets arranged in a triangular relationship wherein first and second sprockets are spaced horizontally from one another and a third sprocket is disposed between and spaced vertically from said pair of sprockets.

19. The apparatus of claim 18 wherein said group of first upper sprockets entrains and supports said upper bight section of said chain by said upper bight section thereof passing over said first and second sprockets and under said third sprocket.

20. The apparatus of claim 17 wherein said single second upper sprocket entrains and supports said lower bight section of said chain by lower bight section thereof passing over said single upper sprocket.

21. The apparatus of claim 17 wherein said means for drivingly interconnecting said single second upper sprocket and said at least one of said group of first upper sprockets includes a differential arrangement coupled with said one of said group of first upper sprockets and said single second upper sprocket.

22. The apparatus of claim 17 wherein said differential arrangement includes a pair of differential sprockets mounted for rotation with said one of said group of first upper sprockets and said single second upper sprocket and a roller-and-link type chain entrained over said pair of differential sprockets, the one of said differential sprockets mounted with said single second upper sprocket being larger in diameter than the other of said differential sprockets.

23. The apparatus of claim 17 further comprising:

a timing arrangement coupled to said group of first upper sprockets so as to cause said group of upper sprockets to rotate in unison.

24. The apparatus of claim 17 wherein said means for applying rotary motion includes a plurality of shafts respectively mounting each of said upper sprockets, at least one of said shafts having an end extending therefrom for coupling with a tool to apply the rotary motion thereto to move the chain and rotate the spockets.

25. The apparatus of claim 17 wherein said means for applying rotary motion includes a pair of shafts respectively mounting said lower sprockets, at least one of said shafts having an end extending therefrom for coupling with a tool to apply the rotary motion thereto to move the chain and rotate the sprockets.

* * * * *